US011668083B2

(12) United States Patent
Schneider et al.

(10) Patent No.: US 11,668,083 B2
(45) Date of Patent: Jun. 6, 2023

(54) SYSTEM AND METHOD FOR AUTOMATIC DISPENSING OF A LIQUID

(71) Applicants: Evan Schneider, Piedmont, CA (US); Daniel Haarburger, Boulder, CO (US)

(72) Inventors: Evan Schneider, Piedmont, CA (US); Daniel Haarburger, Boulder, CO (US)

( * ) Notice: Subject to any disclaimer, the term of this patent is extended or adjusted under 35 U.S.C. 154(b) by 18 days.

(21) Appl. No.: 17/468,505

(22) Filed: Sep. 7, 2021

(65) Prior Publication Data

US 2022/0074185 A1 Mar. 10, 2022

Related U.S. Application Data

(60) Provisional application No. 63/075,332, filed on Sep. 8, 2020.

(51) Int. Cl.
*E03D 9/03* (2006.01)
*E03D 9/02* (2006.01)

(52) U.S. Cl.
CPC ..... *E03D 9/038* (2013.01); *E03D 2009/028* (2013.01)

(58) Field of Classification Search
CPC ..... E03D 9/038; E03D 2009/028
USPC ..... 4/225.1
See application file for complete search history.

(56) References Cited

U.S. PATENT DOCUMENTS 4,429,423 A * 2/1984 Syrenne ..... E03D 9/037 4/225.1
4,760,612 A * 8/1988 Dufau ..... E03D 9/037 4/225.1
11,104,870 B1 * 8/2021 Diaz ..... C11D 1/36
2007/0289054 A1 * 12/2007 Han ..... E03D 9/038 4/225.1
2009/0265842 A1 * 10/2009 Higgins ..... E03D 9/037 4/225.1
2018/0238036 A1 * 8/2018 Schneider ..... E03D 9/037

* cited by examiner

*Primary Examiner* — Huyen D Le
(74) *Attorney, Agent, or Firm* — AKC Patents, LLC; Aliki K. Collins

(57) ABSTRACT

A system for automatic dispensing of a liquid into a toilet bowl includes a dispenser and a liquid refill cartridge. The dispenser mechanically interfaces with the toilet tank and connects with the water supply therein. When the toilet is flushed, fresh water flows from the float valve into the dispenser, and then back into the toilet bowl via the overfill tube. Within the dispenser, the water flow is constricted through an integral venturi before exiting. The venturi yields a pressure differential inside the dispenser that pulls liquid from the refill cartridge and into the outflow of water. A specified volume of liquid is drawn from the liquid refill cartridge and dispersed into the toilet bowl after every flush, without the use of electronics. The liquid may be an odor blocking liquid, a scented liquid, a colorant, enzymes, or a cleaning solution, among others.

24 Claims, 18 Drawing Sheets

SYSTEM AND METHOD FOR AUTOMATIC DISPENSING OF A LIQUID

CROSS REFERENCE TO RELATED CO-PENDING APPLICATIONS

This application claims the benefit of U.S. provisional application Ser. No. 63/075,332 filed on Sep. 8, 2020 and entitled DEVICE AND METHOD FOR AUTOMATIC DISPENSING OF A LIQUID, which is commonly assigned and the contents of which are expressly incorporated herein by reference.

FIELD OF THE INVENTION

The present invention relates to a system and a method for automatic dispensing of a liquid and in particular to a system and a method for automatic dispensing of an odor blocking liquid or a cleaning liquid into a toilet.

BACKGROUND OF THE INVENTION

A new trend in the bathroom fragrance market is the "before you go spray" (BYG). BYGs act on toilets, purportedly preventing unpleasant odors from spreading into a bathroom by blocking particulates from leaving the toilet in the first place. They achieve this by distributing a thin film of oil across the water (or emulsified within the water) in a toilet bowl such that when one uses the toilet, the film wraps around any solid excrement below the water surface, thereby trapping in particulate matter that could otherwise float into the air and cause a smell. Beyond wrapping excrement, the surface tension of the oil layer can also serve as a seal on the top of the water. This provides a second protective layer to trap unwanted, odor-producing particulates and prevent them from rising up and out of the bowl. Many BYGs are formulated with a mild scent, which further helps to mask any odors that arise from the toilet; such scents are especially helpful in combating foul smells associated with gas, whose scents cannot be "trapped" as easily as solid waste.

This functionality is quite different to existing deodorizing sprays and odor-masking systems like candles, matches, and perfumes. Traditional systems function only to mask odors by overpowering them with other scents after they've been created. Sometimes this can be effective, but more often than not this results in an unpleasant medley of good and bad scents. Furthermore, since existing solutions only mask scents after they've been produced, a large amount of perfume may be needed to achieve the goal. This can mean that the "positive" scent needs to be incredibly strong to overcome a particularly odorous bathroom visit, which might be too intense and therefore not enjoyable for the user. It is therefore not surprising that the milder and often more effective BYG category has grown significantly in recent years.

However, BYGs have drawbacks of their own. The largest is the fact that you need to use the spray before visiting the toilet, unlike traditional masking fragrances that can be used before or after. It is common for users to forget to use BYGs before their visit to the toilet, only realizing afterwards that they are in need of an odor remedy. Furthermore, it can be unpleasant for BYG users to bend over and spray the toilet bowl before using the bathroom, both from a physical perspective (for example older or handicapped users), and from a hygienic one (crouching over a toilet, especially if it is not your own).

The present invention provides a novel solution to these issues. It is also a significant improvement to the user experience for other situations when interfacing with a toilet on a repeated basis, like regularly applying a cleaning solution.

SUMMARY OF THE INVENTION

The Automatic Dispensing System described herein includes a dispenser body (Dispenser) and a liquid cartridge (Refill). The Dispenser mechanically interfaces with the tank of a toilet and connects with the water supply therein. When the toilet is flushed, fresh water flows from the float valve into the Dispenser, and then back into the bowl of the toilet via the overfill tube located in the toilet tank. Within the dispenser, the water flow constricts (through an integral venturi) before exiting. This venturi yields a pressure differential inside of the Dispenser that pulls liquid from the Refill tank (via a branched inlet to the venturi) into the outflow of water. The result is a system that draws a specified volume of functional liquid (Liquid)—for example a scent blocking fluid—into the toilet bowl after every flush, without the use of electronics.

There are several mechanisms with the Automatic Dispensing System that facilitate the effective dosing of scent blocking liquid. First is the Venturi mechanism that draws the Liquid into the water flow. The second is the mechanism that modulates the flow of Liquid with every flush. Third is the interface between the Refill and the Dispenser that facilitates the effective flow of Liquid between the two, while preventing unwanted leakage, vacuum buildup, and other undesirable factors. Additional features exist as well to facilitate easy and proper functioning of the device.

In general, in one aspect, the invention features a device for automatic dispensing of a liquid including a dispenser body, a container comprising the liquid to be dispensed, and a Venturi tube. The Venturi tube has an inlet, an outlet and a constriction portion located between the inlet and the outlet, and the inlet is fluidly connected to a fluid source. A dispensing line fluidly connects the container to the constriction portion of the Venturi tube. Flowing of fluid from the fluid source through the Venturi tube causes a volume of the liquid to be drawn into the Venturi tube via the dispensing line and the drawn liquid and the fluid are mixed and dispensed via the outlet. The fluid source may be a toilet water tank that provides water to a toilet bowl upon flushing activation and the outlet of the Venturi tube is configured to dispense the drawn liquid into a water tank overfill tube that empties into the toilet bowl after flushing.

Implementations of this aspect of the invention include one or more of the following. The device further includes a liquid release assembly that includes a main body, a through-opening formed in the main body, a spring, and a ball. The ball interfaces with a constriction formed in the through-opening of the main body to form a watertight seal of the through-opening when the spring is extended. The device may further include a release needle assembly that includes a needle that has a first open end that connects to the dispensing line and a second open end that is inserted into the through-opening of the main body. The second open end of the needle is configured to displace the ball in order to release the watertight seal of the through-opening and allow the volume of the liquid to be drawn into the Venturi tube via the dispensing line. The release needle assembly may further include a drip trough configured to collect any unwanted leakage of the liquid. The dispenser body may include a bent portion through which the dispensing line passes. The dispenser body is removably attached to a container of the fluid source via one of mechanical connection, magnetic connection, adhesive connection, a hook or a hook and loop type of connection. The liquid may be an odor shielding liquid that mixes with the water that collects in the toilet bowl after flushing and forms an odor shielding film on a top surface of the water that collects in the toilet bowl after flushing. The liquid may be an odor shielding liquid that mixes with the water that collects in the toilet bowl after flushing and the odor shielding liquid forms an emulsion with the toilet bowl water that encapsulates solid waste. The liquid may be one of an odor shielding liquid, a scented liquid, a colorant, enzymes, or a chemical cleaning solution. The odor shielding liquid may be one of odor shielding oils, emulsifiers, thinners, scents, bubble forming liquids, or coloring agents. The container may be removably attached to the dispenser body or may be integrated with the dispenser. The device may further include a first tube connected to the inlet of the Venturi tube and a second tube connected to the outlet of the Venturi tube and wherein the fluid flows from the fluid source into the Venturi tube via the first tube and subsequently the mixed fluid and drawn liquid exit the Venturi tube via the outlet and are dispensed via the second tube.

In general, in another aspect, the invention features a toilet including a toilet bowl, a toilet water tank fluidly connected to the toilet bowl and configured to provide water to the toilet bowl upon flushing activation, and a device for automatic dispensing of a liquid into the toilet bowl after flushing with water is completed. The device for automatic dispensing of a liquid includes a dispenser body, a container comprising the liquid to be dispensed, and a Venturi tube. The Venturi tube has an inlet, an outlet and a constriction portion located between the inlet and the outlet, and the inlet is fluidly connected to the toilet water tank. A dispensing line fluidly connects the container to the constriction portion of the Venturi tube. Flowing of water from the toilet water tank through the Venturi tube causes a volume of the liquid to be drawn into the Venturi tube via the dispensing line and wherein the drawn liquid and the water are mixed and dispensed via the outlet into a water tank overfill tube that empties into the toilet bowl after flushing with water is completed.

In general, in another aspect, the invention features a method for automatic dispensing of a liquid including the following. Providing a dispenser body and a container comprising the liquid to be dispensed. Next, providing a Venturi tube having an inlet, an outlet and a constriction portion located between the inlet and the outlet, and wherein the inlet fluidly connects to a fluid source. Next, flowing of a fluid from the fluid source through the Venturi tube thereby causing a volume of the liquid to be drawn into the Venturi tube via the dispensing line and wherein the drawn liquid and the fluid are mixed and dispensed via the outlet. The fluid source may be a toilet water tank that provides water to a toilet bowl upon flushing activation and the outlet of the Venturi tube is configured to dispense the drawn liquid into a water tank overfill tube that empties into the toilet bowl after flushing.

The present invention provides an automated liquid dispensing solution, free of electronics, and activated solely by the use of the toilet. While alternate, future embodiments may include ancillary features with electronics, the core invention uses the natural fluid dynamics of a toilet, as well as uniquely applied principles of physics and design to dispense a range of liquids into a toilet bowl after every use. For BYGs, this means that users no longer have to remember to use the spray before every visit to the toilet. Instead, after every flush the toilet is "primed" for use the next time. This same principle can be used for other applications too, such as automatic dispensing of a cleaning solution or even the application of enzymes to aid in the breakdown of excrement for off-grid scenarios.

The details of one or more embodiments of the invention are set forth in the accompanying drawings and description below. Other features, objects, and advantages of the invention will be apparent from the following description of the preferred embodiments, the drawings and from the claims.

DETAILED DESCRIPTION OF THE INVENTION

The present invention provides a system and a method for automatic dispensing of an odor blocking liquid or a cleaning liquid into a toilet.

Figure 1:
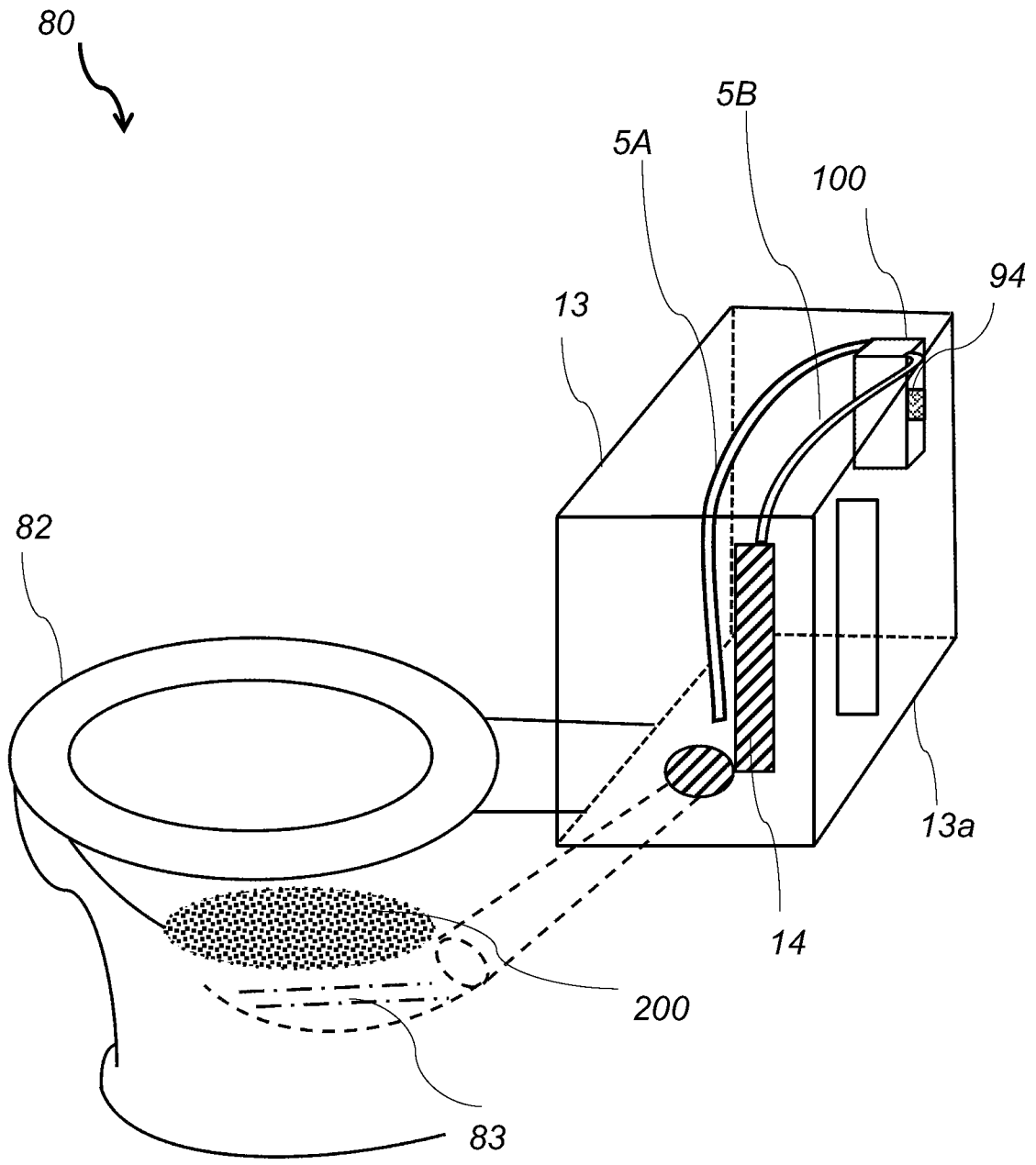
FIG. 1 is an overview diagram of a system for automatic dispensing of a liquid into a toilet, according to this invention.
Figure 2:
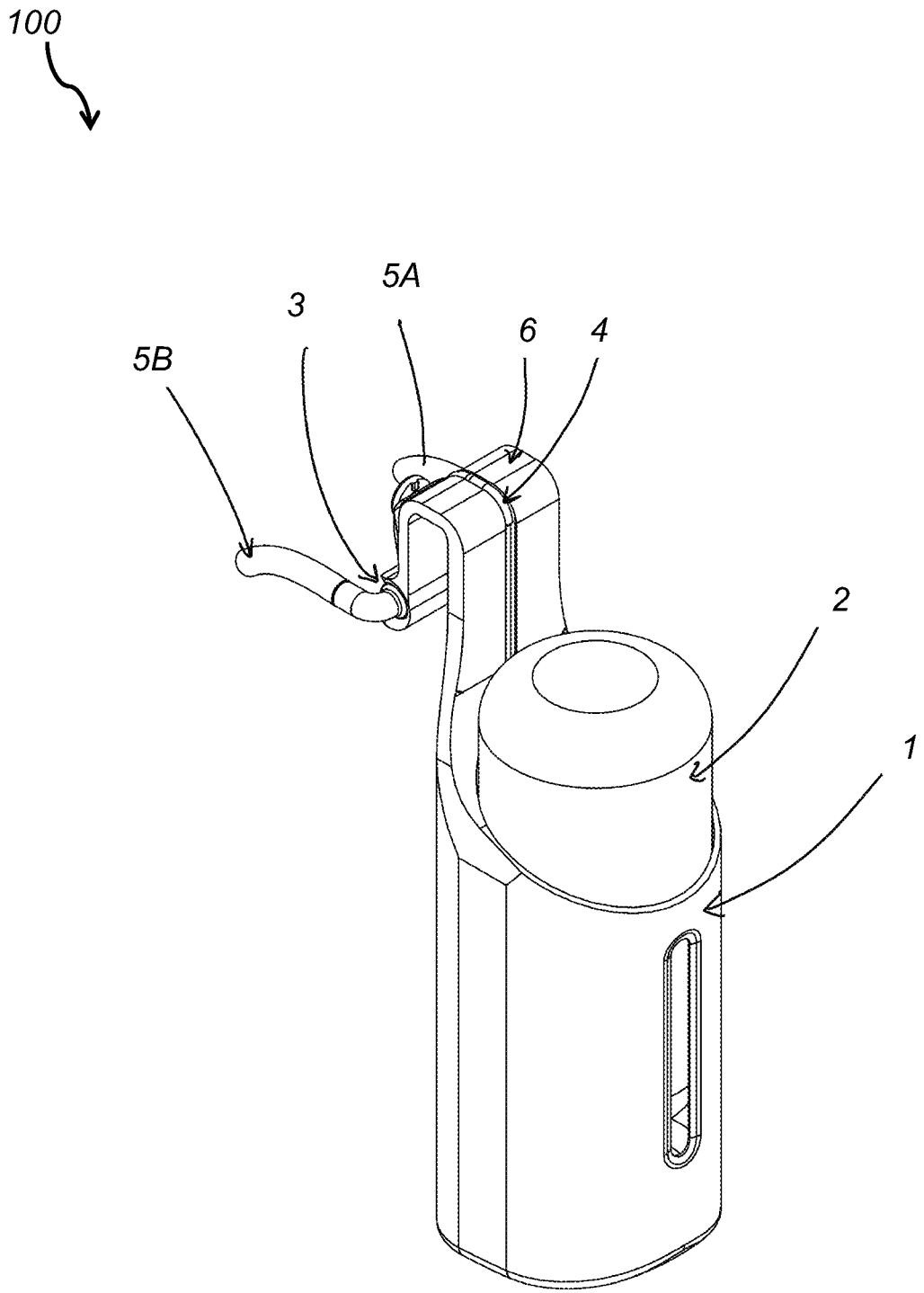
FIG. 2 is perspective side view of a device for automatic dispensing of a liquid according to this invention.

Referring to FIG. 1, a device 100 for automatic dispensing of a liquid into a toilet 82 is attached to a wall 13*a* of a water tank 13 that provides water to the toilet 82. Device 100 includes a dispenser body 1 (Dispenser), a liquid cartridge (Refill) 2 and a tube 5B that feeds a dose of the liquid that is contained in the liquid cartridge 2 into the water tank overfill tube 14, as shown in FIG. 2. In one example, the liquid is an odor shielding liquid that mixes with the bowl fill water and forms an odor shielding film 200 on the top surface of water 83 that collects in the toilet bowl 82 after flushing of the toilet. In other examples, the liquid may be a scented liquid, a colorant, enzymes, or a cleaning solution, among others. The liquid cartridge 2 may be removably attached to the dispenser body 1 or may be integrated with the dispenser body 1.

FIG. 2 is a front, left, top, perspective view of an embodiment of the Automatic Dispensing System 100 consistent with the disclosure herein. In it, the dispenser body 1 receives a liquid cartridge 2 that contains a functional liquid (Liquid) that is to be dispensed during use. That Liquid is drawn through a dispensing line 4 into the Venturi system 3 that connects to a water source such as a toilet float valve by means of an inflow tube 5A. During use, the combination of water and Liquid is redirected into its desired location—in this case the bowl of the toilet 82 by means of the overflow tube 14 via the outflow tube 5B on the other end of the Venturi 3. A hook 6 is built in to the dispenser body 1 which protects the dispensing line 4 during use (for instance, from being crushed by the lid of the toilet tank) and also provides for easy attachment of the dispenser to the toilet.

Figure 3:
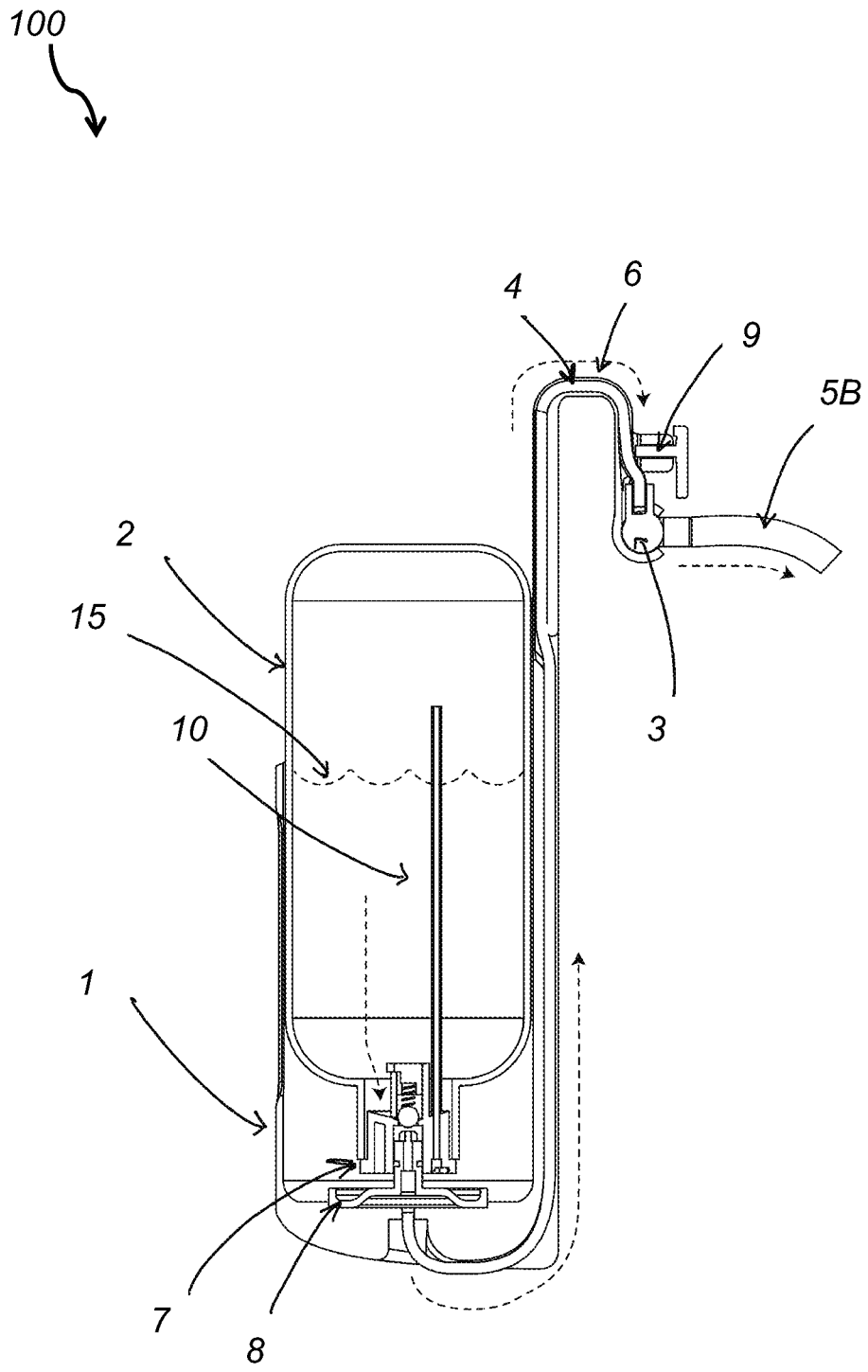
FIG. 3 is a side cross-sectional view of the device for automatic dispensing of a liquid of FIG. 2.

FIG. 3 is a right side section view of the embodiment in FIG. 2 and provides clarity on fluid flow and the mechanics of the invention. In it, the liquid cartridge 2 is notably inverted such that the top of the cartridge interfaces with the dispenser by means of a liquid release mechanism 7 on the cartridge and a release needle assembly 8 that connects to or is part of the dispenser body 1. Additional detail will explain the functionality of the liquid release mechanism 7 and the release needle assembly 8 in subsequent figures. However, the noteworthy feature is that the liquid release mechanism 7 acts to stop any unwanted fluid flow out of liquid cartridge 2 while disconnected. When connected to the release needle assembly 8, however, the Liquid can flow freely from the liquid cartridge 2 through the dispensing line 4 into the Venturi 3 and out through the outflow tube 5B as indicated.

Note that in alternative embodiments, the fluid may enter the dispensing line 4 through a myriad of methods that may or may not include use of a liquid release mechanism. For instance, in one embodiment, the dispensing line may directly enter the liquid 15 contained in the refill cartridge 2, or may be connected to a straw, tube, or the like that interfaces with the liquid 15 without a release mechanism. Said release mechanism is particularly useful for the depicted embodiment wherein the refill cartridge is inverted. However, when this is not the case the utilization of the aforementioned components may vary.

FIG. 3 also illustrates other features of the Automatic Dispensing System. For instance, connected to the liquid release mechanism 7 is a venting tube 10 that extends above the surface of the liquid 15 when the refill cartridge 2 is inverted. The venting tube 10 transfers air into the refill cartridge 2 when liquid is drawn out of the cartridge during use. This normalizes the pressure in the cartridge, preventing a vacuum from building up which would otherwise inhibit the flow of Liquid out of refill cartridge 2. Note in the depicted embodiment this venting system is achieved with a venting tube. However, in alternate versions a similar outcome may be achieved with a one way valve, a top inlet, access point, via the inactive Venturi (without a dedicated vent), or the like.

Also visible in FIG. 3 are details by which the dispensing line 4 connects with the Venturi 3. Specifically, above the venturi system is a flow regulation system 9 that enables the user to adjust the flow of Liquid during use. This mechanism is important in order to accommodate different types of toilets, as well as other variation across use cases. For instance, with scent blocking liquid it is important to control how much liquid is being dispensed. If too little liquid is released, the Liquid may not effectively block scent. If too much is released, then the refill cartridge may empty too quickly, making the device expensive and inconvenient for long term use and/or creating a scent in the bathroom that is too strong. Here, the flow regulation system 9 consists of a mechanism that applies pressure to the dispensing line 4 which in this case is made of a flexible material. When pressure is applied, the dispensing line 4 deforms and the path through which the Liquid flows is constricted, thereby reducing fluid flow. Other embodiments may employ a similar mechanism or others such as a needle valve, a ball valve, or the like. Additionally, multiple flow regulation or dosing mechanisms may be used in conjunction. For instance, there may be an intermediary reservoir of Liquid that fills upon each use. After flush this reservoir would discharge, permitting only that specific volume of liquid to be dispensed. This dosing system could be used on its own, or could be used with an additional flow regulation system to enable more fine-tuned control by the user. The combination of these two features—the dosing system and flow regulation system—would ensure that the amount of liquid dispensed never exceeds a specific volume, yet that users are able to reduce the liquid dispense to a lesser volume if desired, and are also able to control the pace of Liquid flow throughout a flush cycle.

FIG. 3 also shows the dispensing line 4 relative to the dispenser hook 6 in order to illustrate how the rigid hook body protects the line 4 for instance from being crushed and deformed by the toilet lid when closed. The thickness of the hook 6 is equal to or greater than a threshold fraction of the thickness of the dispensing line 4 such that when pressure is applied across the hook 6 the line is not deformed enough to prevent or substantively hamper fluid flow. Put simply, the hook 6 protects the dispensing line 4 from being crushed, thereby protecting fluid flow. Notably, in some scenarios there may be multiple points of pressure acting on the hook and the line. These pressure points may be planar (i.e. coming from the top) or may act on the line at different heights or positions. For instance, many toilet tank lids feature a ledge that drops down for proper alignment of the lid to the tank. In these cases, the inline positioning of the dispensing line 4 relative to the hook 6 is important. As the hook 6 curves and drops below the its crest (i.e. drops below the edge of the tank) it continues to protect the dispensing line 4. This prevents the line 4 from being crushed or excessively constricted lower in the tank, thereby creating a system that can be used universally across toilets of different makes. In alternative embodiments, different mechanisms may be used to prevent deformation of the dispensing line. For instance, while the depicted hook 6 is built into the body of the dispenser and serves to both protect the dispensing line 4 and anchor the dispenser body 1 to the toilet tank, in other embodiments these two roles may be served by separate features. An independent spacer might protect the line, for instance, while a hook or suction cup anchors the body to the toilet tank. Alternately, the dispenser may be positioned on a stand, or may be situated on the floor or on top of the toilet lid rather than using a hook. In these cases, a separate feature would be used to prevent the line from being crushed. Similarly, the line may be segmented or made of a more rigid material such that it naturally resists crushing. This could take place across the full length of the line or simply at the point where pressure is applied to the line by an outside force like a toilet tank.

Figure 4:
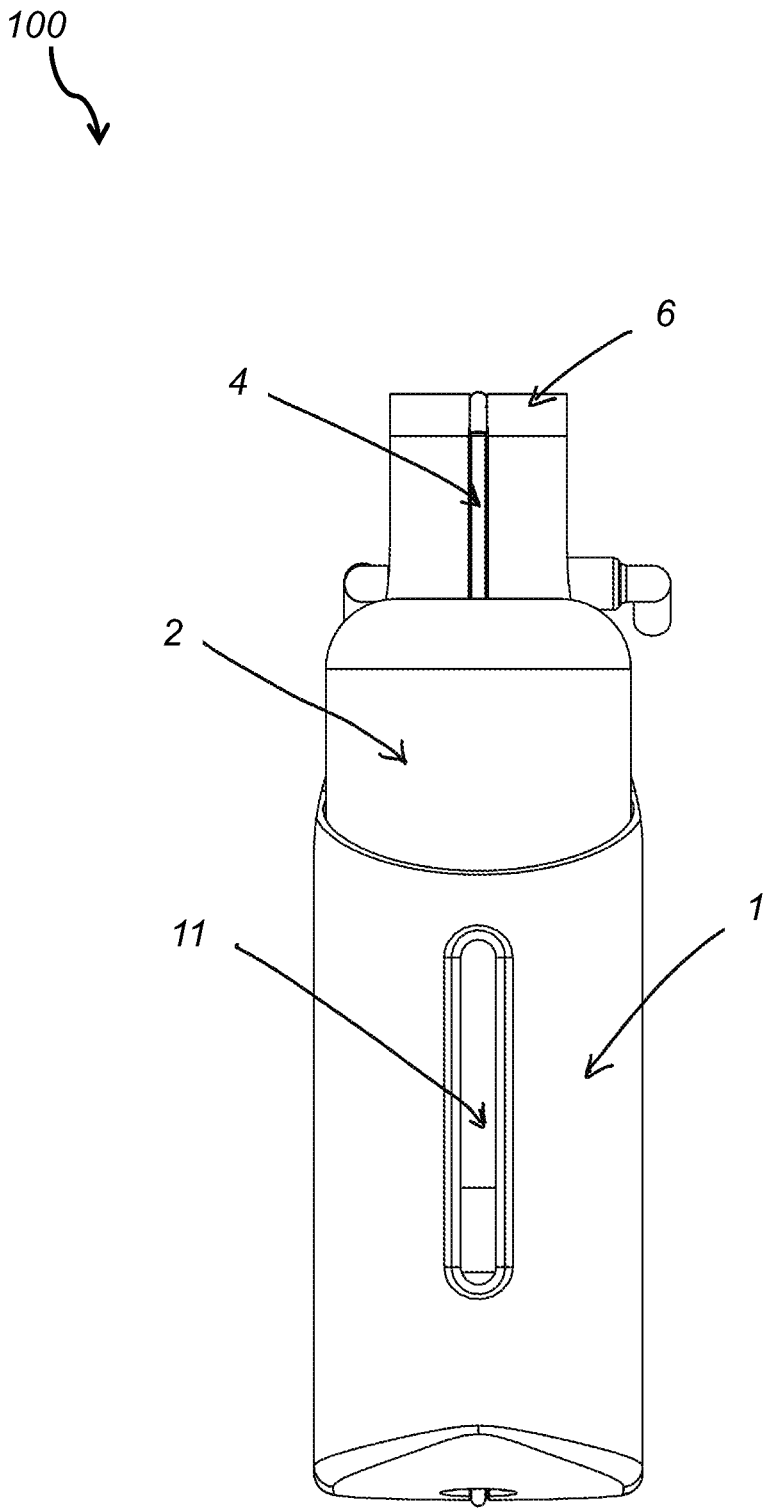
FIG. 4 is a front view of the device for automatic dispensing of a liquid of FIG. 2.
Figure 5:
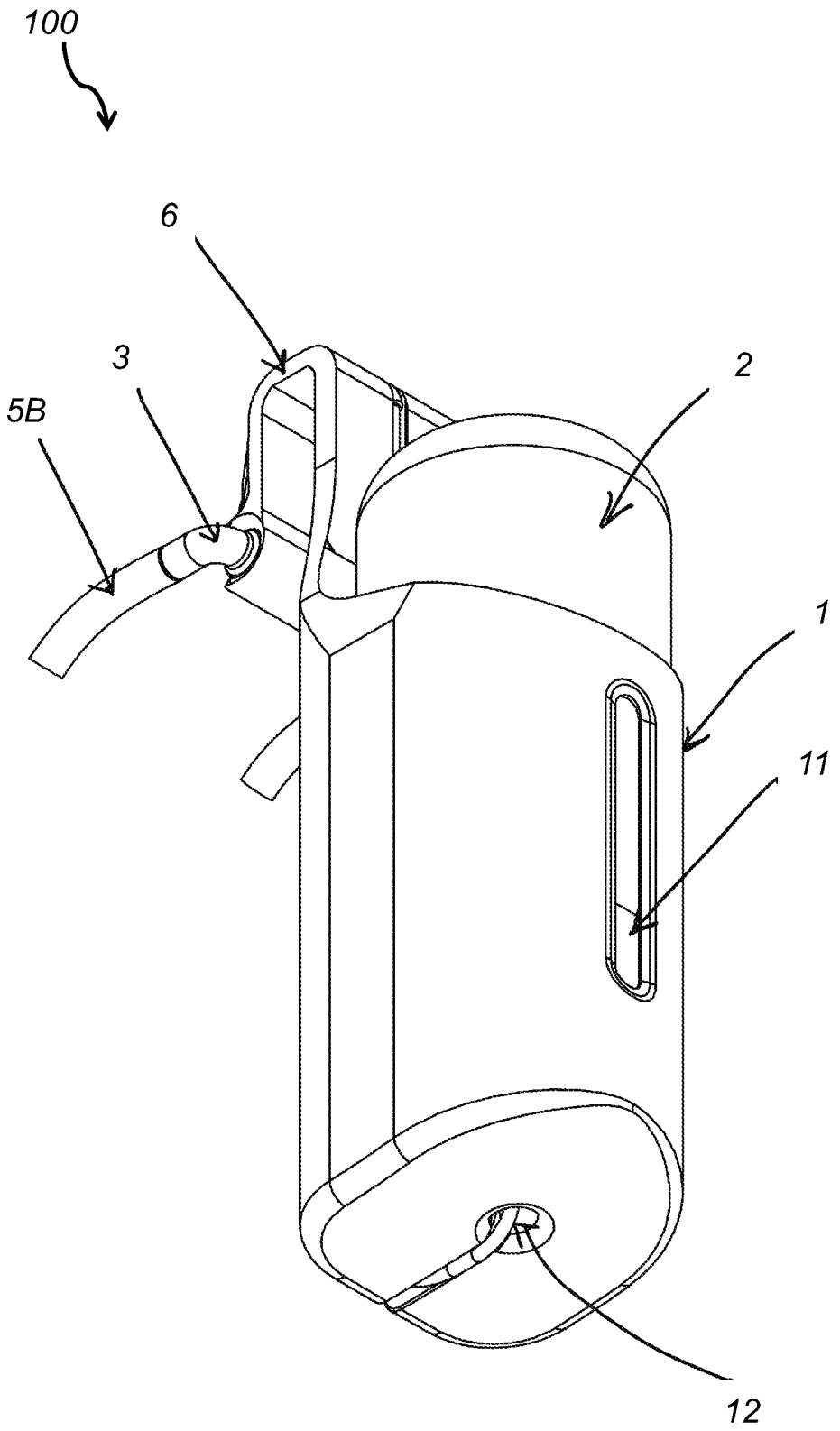
FIG. 5 is a bottom perspective view of the device for automatic dispensing of a liquid device of FIG. 2.

FIG. 4 depicts the embodiment in FIG. 2 and FIG. 3 from a front view. Notably, the dispensing line 4 is positioned inline with the hook 6. Additionally, a front window 11 on the body of the dispenser allows a user to view the refill cartridge 2 when in use. This is helpful for determining if the refill cartridge 2 is empty and needs to be replaced. FIG. 5 illustrates these features in more detail, as well as a bottom access point 12 by which the dispensing line 4 connects to the needle release assembly 8. It is understood that the front window 11 could be located on the side of the dispenser body in other embodiments and serve the same purpose, or could change in shape/size.

Figure 6:
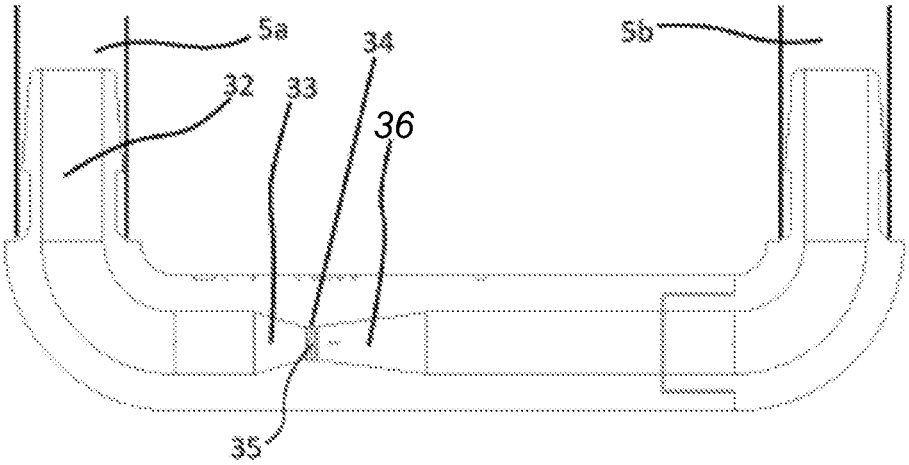
FIG. 6 is cross-sectional view of the Venturi system used in the device of FIG. 2.

FIG. 6 is a detailed cross-sectional view of Venturi system 3. Inflow tube 5*a* connects to the Venturi system via hose barb 32, directing fluid flow to the converging cone of the Venturi, 33. In this area, as governed by the Bernoulli equations, fluid pressure is reduced as the fluid gathers the velocity necessary to traverse the pinch-point at a constant mass-transfer rate. At point 34 the fluid is at its lowest pressure; a pressure low enough that a relative vacuum is created relative to atmospheric pressure. Liquid inlet 35 is connected to liquid cartridge 2 via dispensing line 4, and it is through this connection that the scent blocking Liquid of interest is drawn into the Venturi system and entrained into the fluid flow. The combined fluid (refill water plus scent blocking Liquid) then passes through the diverging cone 36 of the Venturi, where the fluid flow slows down as local pressure is recovered. Finally, the combined fluid flows out of the Venturi via outflow tube 5*b*, eventually being deposited into the toilet bowl via overflow tube within the toilet tank. It is understood that various Venturi system configurations or other passive means could be used to achieve the same goal.

Figure 7:
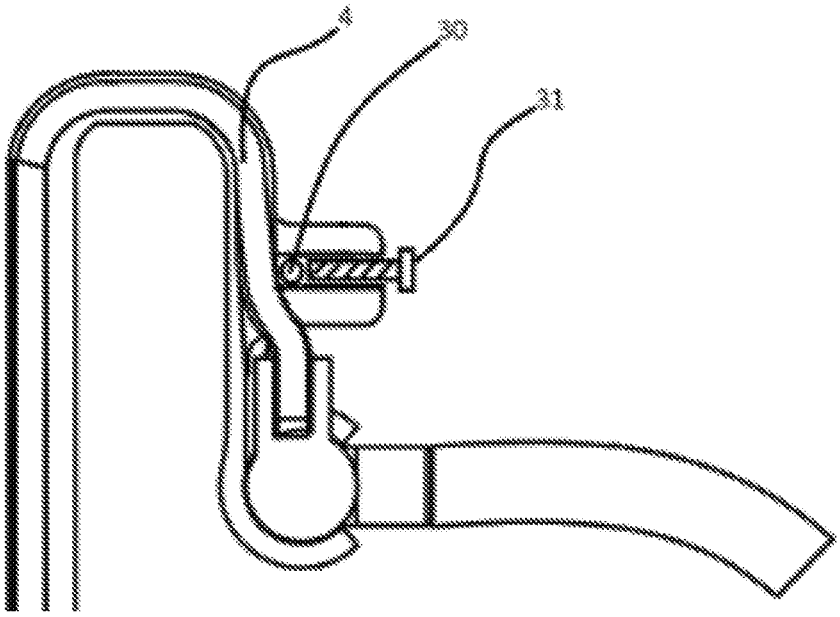
FIG. 7 is a detailed view of the flow regulation system used in the device of FIG. 2.

FIG. 7 shows in detail view how one embodiment of the flow regulation system works. A threaded hole that is integral to hook 6 accepts a small thumb screw or handle 31 (enabling tool-less adjustment). The threaded hole reaches directly to tube 4. A rigid ball 30 (made of steel or other suitable material) is sandwiched between tube 4 and screw 31 such that downward pressure exerted by screw 31 onto tube 4 is transferred via ball 30 to the line, ensuring consistent and damage-free constriction of tube 4 with adjustments. It is important to note that screw 31 should be of a suitable pitch; that is there must be a reasonable range over which adjustment is carried out for general use (for example 2 full turns to go from fully open to fully closed). In alternative embodiments, screw 31 could be placed at an angle, thereby decreasing the "gain" of this means of adjustment. For similar purposes, tube 4 could be doubled back on itself in the adjustment region, such that screw adjustments have a lower gain and are thereby less sensitive to minor or potentially accidental user adjustments. Furthermore, the tube 4 may vary in diameter such that at the point of contact where the ball 30 engages the tube 4 a greater distance must be travelled by the ball 30 in order to achieve full closure.

Figure 8A:
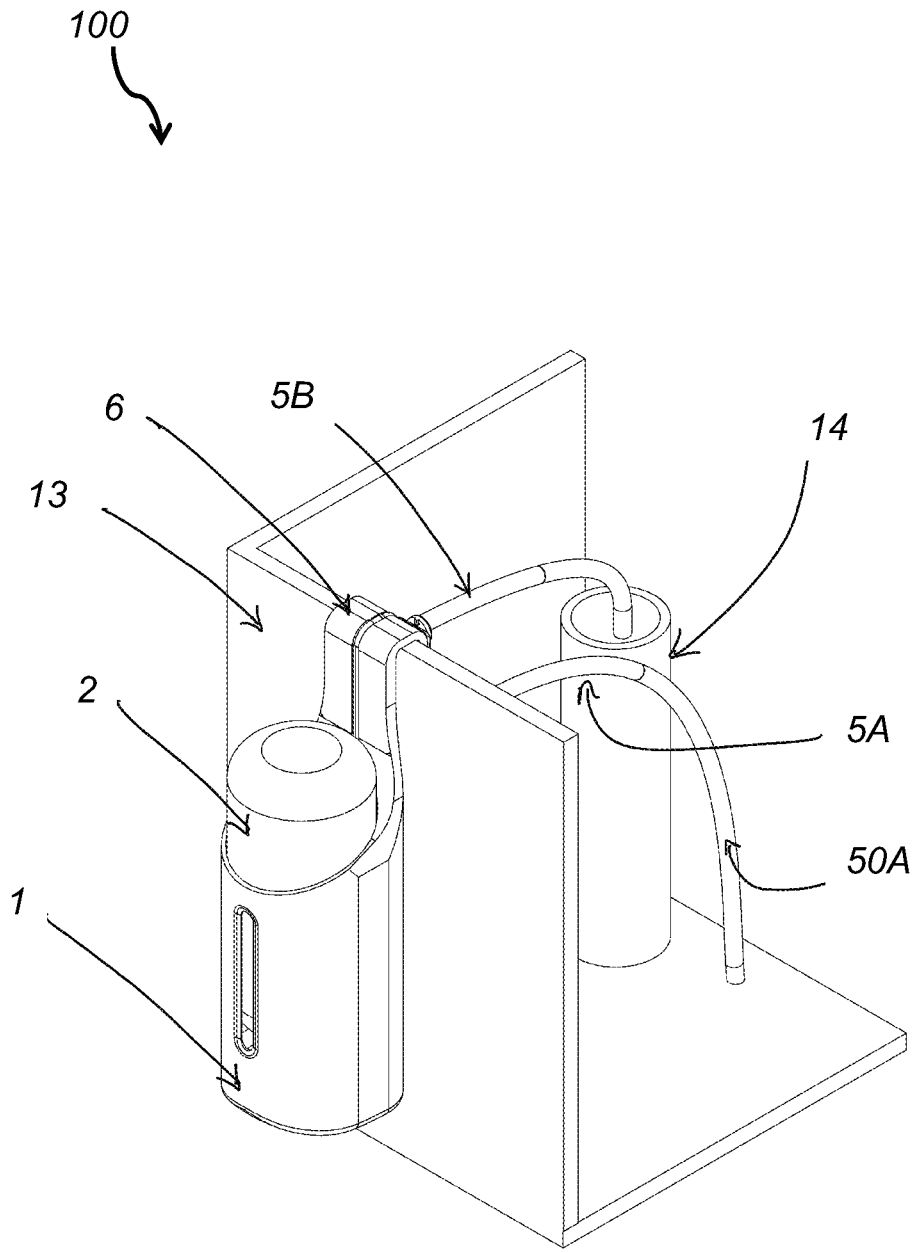
FIG. 8A depicts a front perspective view of the device of FIG. 2 mounted on an outside wall of a toilet tank.

FIG. 8A illustrates an embodiment of the dispenser mounted on a separate body such as a toilet tank 13. In this depiction, the tank is shown with a cutaway view and the dispenser is mounted to its nearest edge by means of the hook 6 attached to the dispenser body 1. Here, the means by which said hook 6 prevents crushing of the dispensing line 4 becomes more apparent. When a lid is mounted to the top of the toilet tank, the pressure bears on the hook 6 pinching it between the lid and the tank wall 13. The rigid body of the dispenser hook 6 protects the line 4 from this pressure, thereby ensuring unimpaired fluid flow during use.

FIG. 8A also illustrates the water flow and discharge of the dispenser. In this figure, the dispenser inflow tube 5A is directly connected to a water supply line 50A which usually originates from a float valve within the toilet water tank. In most toilets this line is directed into the overflow tube 14 and is used to replenish the water in a toilet bowl after flushing. Here, the water supply line is directed instead to the inflow tube 5A such that after each flush water passes through the dispenser's venturi system 3 and draws a small volume of scent blocking liquid into the toilet bowl during refill. This outflow is directed by means of the outflow tube 5B into the tank's overflow tube 14. Of note, the means by which the inflow and outflow tubes interface with the toilet tank can take any myriad of forms including but not limited to use of one or many intermediary hose barbs, coupling components, and/or clips meant to affix to members of the toilet tank. Furthermore, in alternate embodiments the inflow and outflow members may be built directly into the venturi component 3 such that intermediary hoses and components are omitted.

Figure 8B:
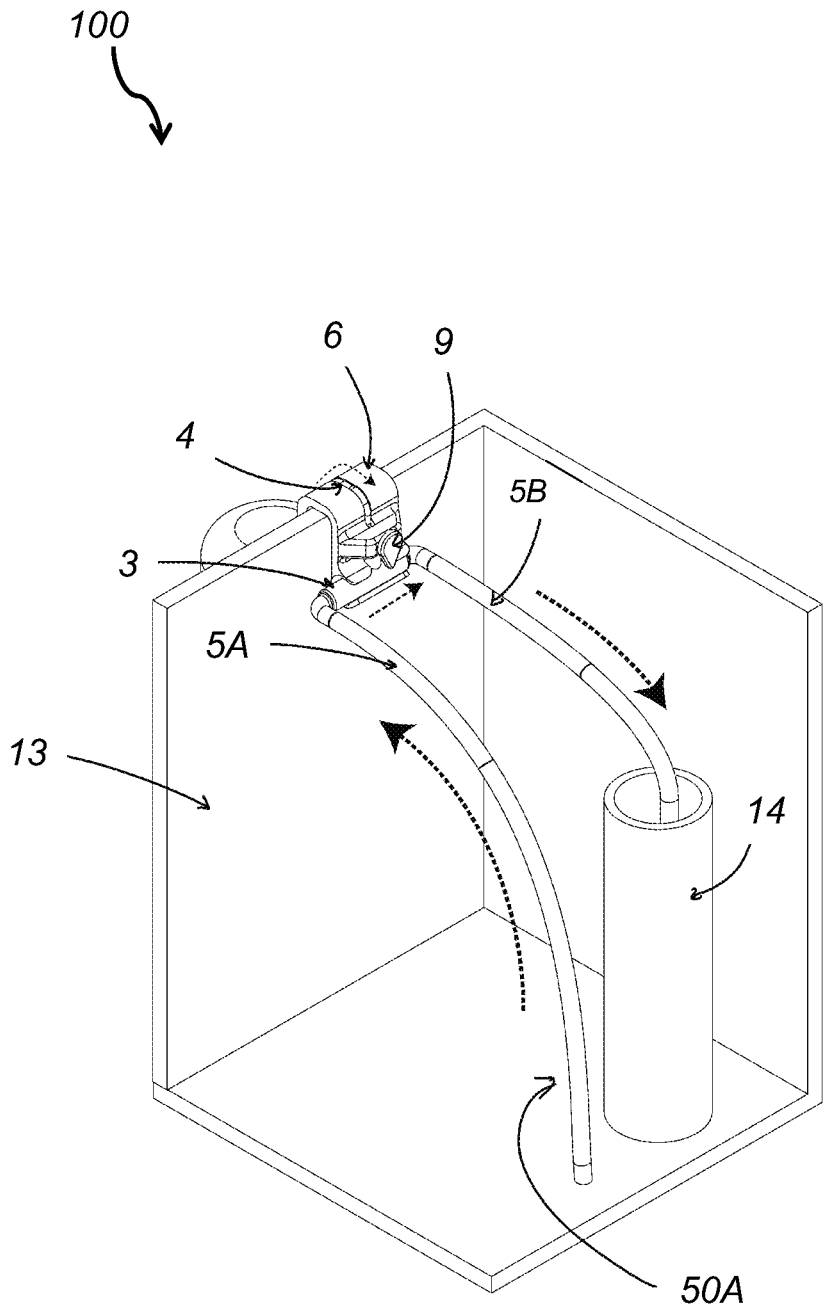
FIG. 8B depicts a rear perspective view of the device of FIG. 2 mounted on an outside wall of a toilet tank.

FIG. 8B illustrates the embodiment of FIG. 8A from a rear perspective view and depicts fluid flow in the dispenser. Water is drawn from the water supply line 50A into the dispenser's inflow tube 5A. Here, it passes into the Venturi system 3, then flows through the outflow tube 5B into the tank's overflow tube. The local change in pressure caused by the Venturi draws Liquid from the refill tank 2 through the dispensing line 4 which wraps over the edge of the toilet tank 13. Near to where this line meets the Venturi, a flow regulating system 9 modulates the rate of liquid that passes into the Venturi and enters the primary flow of water, and thereby serves as a way for users to easily adjust the volume of Liquid dispensed during a typical flush. It is important to note that the flow regulating system 9 could be placed anywhere along line 4 and successfully perform its purpose of tuning flow rate.

Figure 9:
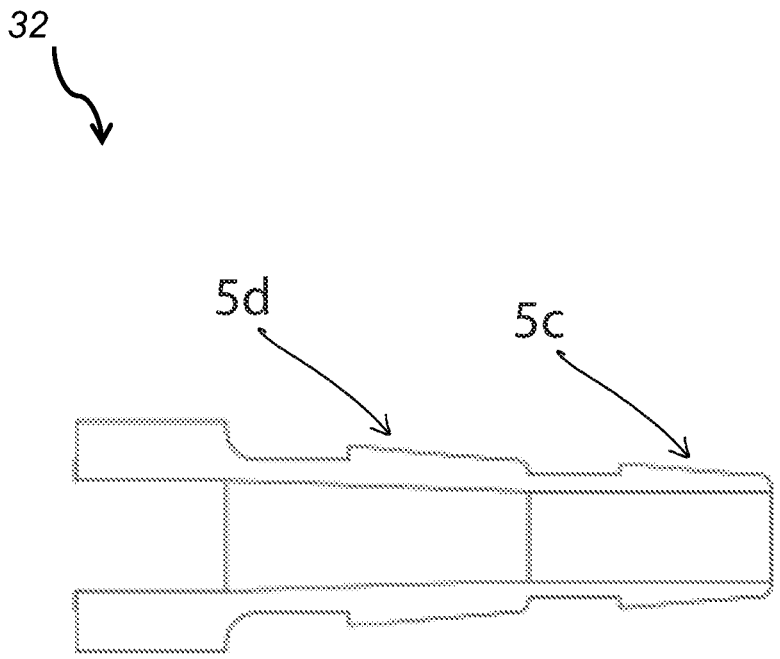
FIG. 9 depicts a side cross-sectional view of a universal hose barb connector 32 used between the Venturi inflow tube and the toilet float valve line in FIG. 6.

A detailed view of one embodiment of a universal connection between the venturi inflow tube 5A and toilet float valve line is shown in FIG. 9. Of note is that this "universal" hose barb termination of inflow tube 5A would interface with a wide variety of toilet makes and models, by accommodating tubing lines of various sizes such as 3/16" and 1/4" internal diameter, which represent two of the most common tubing sizes found in toilet tanks. The steps in the outer wall 5C, 5D corresponds to these diameters to facilitate a tight fitting connection. In alternative embodiments these steps may vary in frequency, size, or shape.

Figure 10:
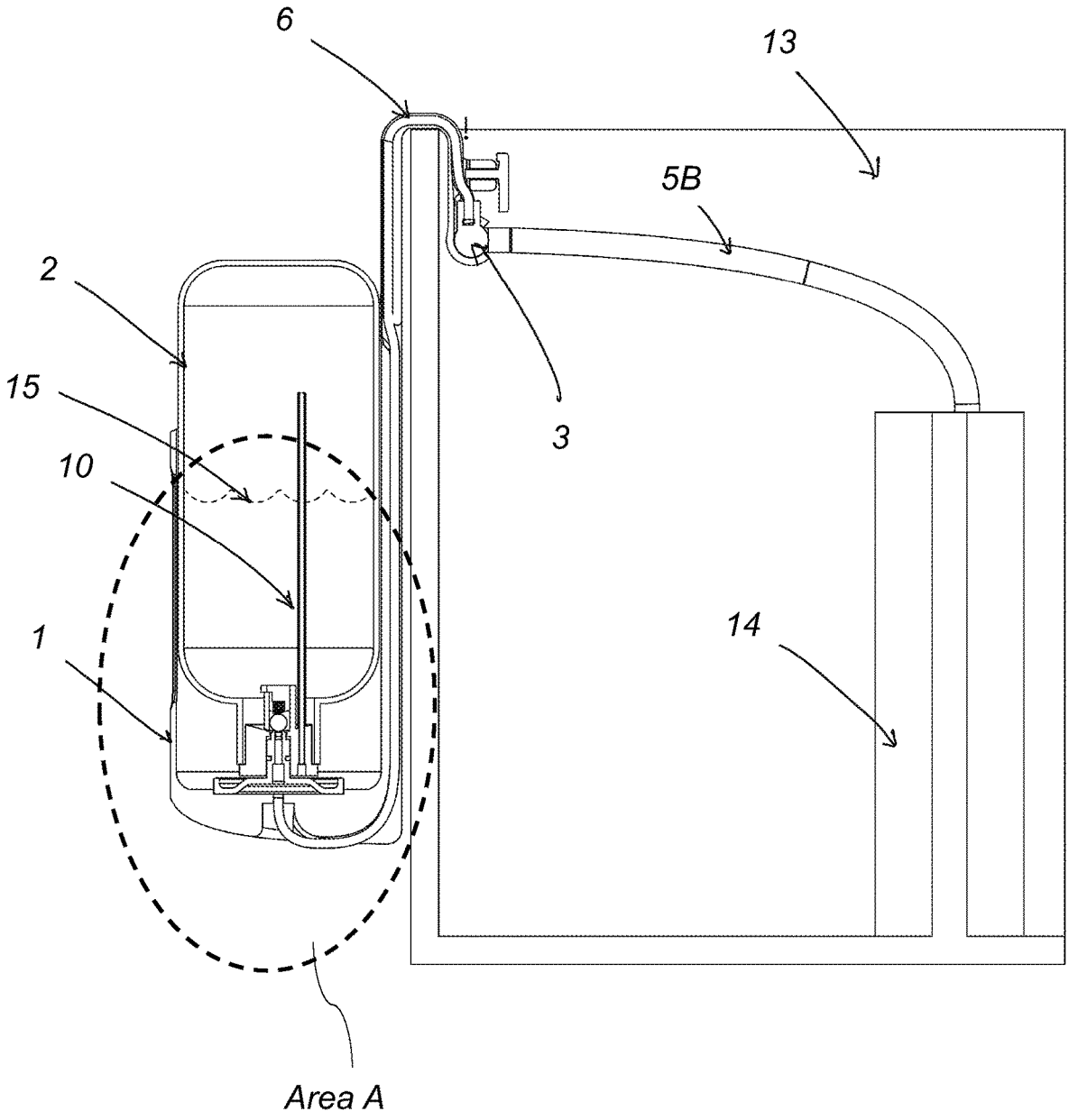
FIG. 10 depicts a left cross-sectional side view of the full assembly of FIG. 8A.

FIG. 10 shows a left cross-sectional side view of the full assembly of FIGS. 8A and 8B. Here, the Liquid level 15 in the tank is shown, which helps convey the utility of the venting system 10 and the proximal position of the Venturi 3. Specifically, in this embodiment the refill tank 2 is positioned beneath the Venturi component 3. This is important so that liquid does not naturally escape the dispenser at rest via the siphon effect (gravitational force). Similarly, the position of the venting tube 10 above the Liquid line 15 guarantees that when Liquid is pulled from the refill tank 2, air is able to enter the tank to replace the volume of the liquid that exited. Features on the release needle assembly 8 such as a lower recess and drip ring keep this venting tube 10 clear, so that liquid does not accumulate and block the proper venting of the tank. Additional detail about the release needle assembly 8, venting system 10, and liquid release mechanism 7 is provided in subsequent figures. Also, of note, in alternative embodiments the means by which this venting action takes place may differ. For instance, the venting system 7 may not exist by means of an extended tube but rather a hole or access valve on the bottle. In this case the valve or hole may be placed at the bottom of the tank (the top when inverted) to prevent unwanted leaks, or may be integrated into the additional features on the side walls or top of the bottle. The vent functionality could also be achieved by use of a breathable membrane material such as expanded PTFE, which would allow the transfer of air but not Liquid across its boundary. Additionally, in embodiments where the tank is not inverted during use, the venting system may simply be an open end at the top of the tank or a small puncture in a removable seal. In yet other embodiments, depending upon the use case or the dispensed liquid, no dedicated venting system is needed at all and a passive Venturi can act as a vent itself. These venting systems and others fall within the purview of the disclosed embodiment.

Figure 11A:
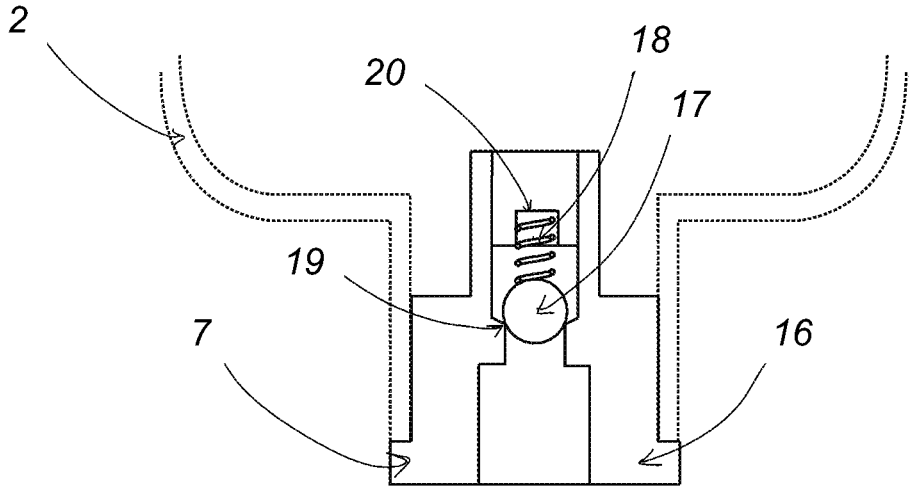
FIG. 11A is a detailed cross-sectional view of the liquid release mechanism 7 built into the refill tank 2 of the device of FIG. 2.

FIG. 11A is a cross sectional detail view of the liquid release mechanism 7 built into the refill tank 2. Here, the liquid release mechanism 7 is an assembly whose dimensions correspond to the open end of the refill tank 2. Within the assembly is a primary body 16, a constricted neck 19, a stopper ball 17, spring 18, and spring holder 20. FIG. 11A depicts the assembly at rest, where the spring 18 is extended and forces the stopper ball 17 against the shoulder of the constricted neck 19. Here the ball 17 provides a seal against the edge of this shoulder, thereby preventing fluid from traveling through the constricted neck 19. In some embodiments either the ball or features of the shoulder or constricted neck may be made of a deformable material such as rubber, silicone, or the like in order to ensure a proper seal at this interface. Alternatively, additional components like as an O-ring seal or gasket may be used to facilitate this water tight seal. Further embodiments may further reduce the number of components involved using unique material properties to combine the functionality of multiple components into one part. For instance, an alternate embodiment the ball and spring assembly may be merged into a single component, such as a rubber stopper with natural spring forces. Similarly, the constricted neck may be designed such that at rest the unit seals without use of a stopper (for instance by constricting to a small enough opening that liquid cannot pass through) then is stretched open by means of a needle release system 8, straw, or the like. Such embodiments fall within the purview of this disclosure.

Figure 11B:
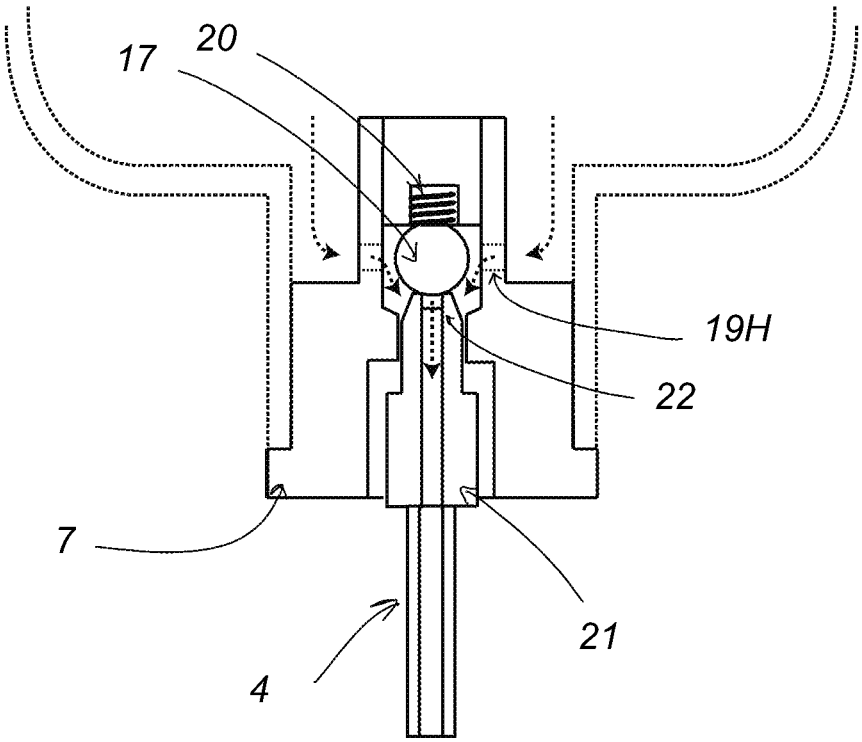
FIG. 11B is a detailed cross-sectional view of the liquid release mechanism 7 of FIG. 11A in use.

FIG. 11B depicts the liquid release mechanism 7 in use, where the needle release system 8 displaces the stopper ball 17 and prevents it from interfacing with the shoulder of the constricting neck 19. As a result, liquid flows through the top of the liquid release mechanism, through holes in the column 1911 that holds the spring and ball components, and through the displacing needle 21 which is connected either directly or by means of intermediary components to the dispensing line 4. Notably, the displacing needle 21 need not actuate in this system. Instead, the displacing needle 21 may be fixed to a stable surface such as the dispenser body 1 of the Automatic Dispensing System and the liquid release mechanism 7 may be the system that moves to compress the spring-ball assembly and release liquid into the dispensing line 4, thereby making the refill process as simple as possible for end users. Additionally, ancillary components may be introduced to further enhance the seal and utility of the liquid release mechanism. For instance, the displacing needle 21 may include O-rings, gaskets, or in-molded components around its circumference in order to prevent unwanted leakage around its sides. Conversely, the constricting neck may house similar features, components, or be made from specific materials such as rubber to achieve the same functionality.

Figure 11C:
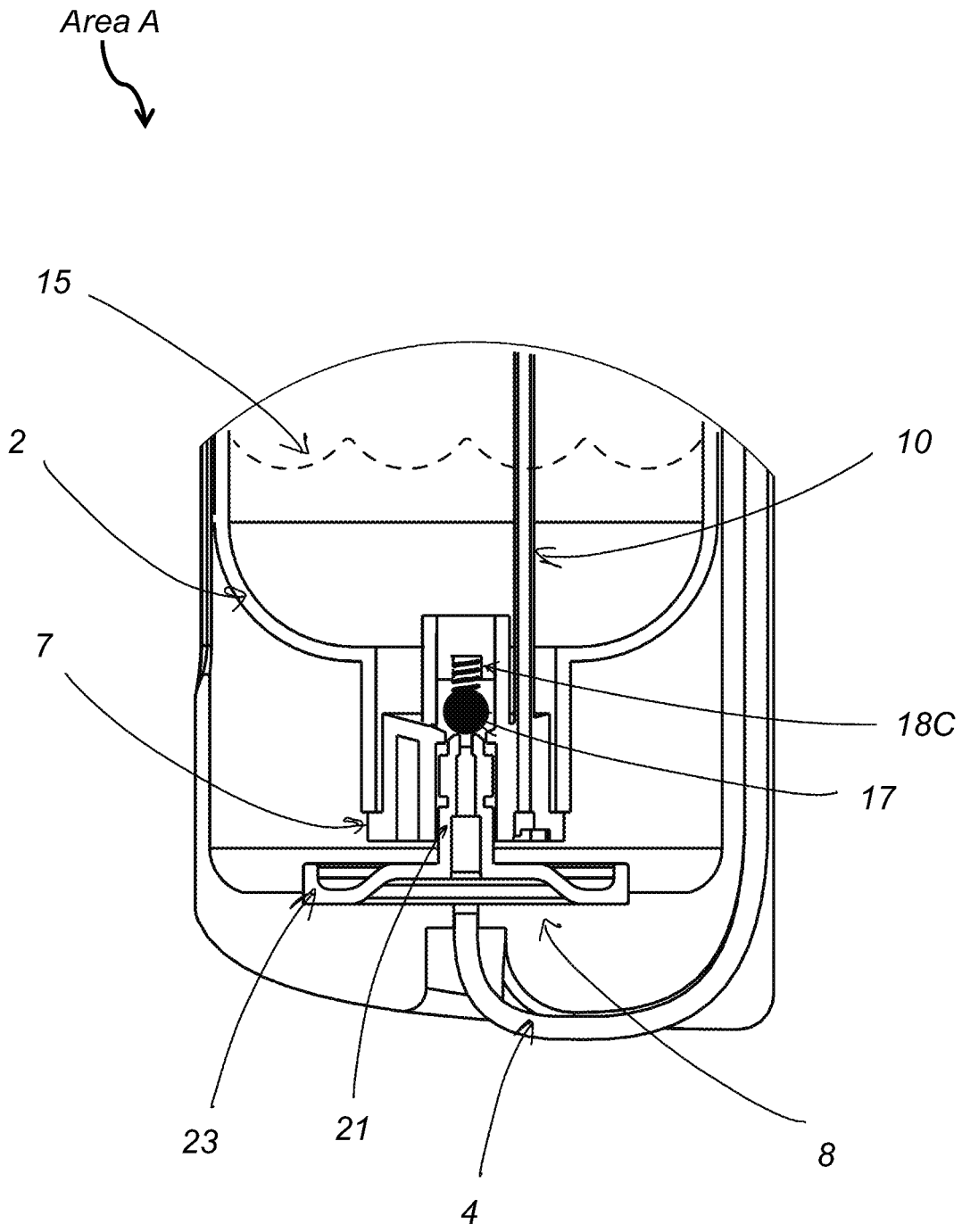
FIG. 11C is an enlarged view of area A in FIG. 10.

FIG. 11C illustrates how a liquid release mechanism consistent with FIGS. 11A and 11B may exist within the context of a greater dispensing assembly. In it, the liquid release mechanism 7 is mounted into a refill tank 2 which is inverted and rests upon a release needle assembly 8. Here, the release needle assembly 8 is a single component with a displacing needle protrusion 21 that forces the stopper ball 17 up from its sealing position, thereby causing the stopper spring 18C to compress and allowing liquid to flow through the release needle assembly 8. The dispensing line 4 then connects directly into the release needle assembly 8, receiving the liquid for transferal to the Venturi system 3 during use. An additional drip trough 23 receives any unwanted leakage that may result from use or during initial assembly. This drip trough 23 prevents said leakage from interacting with the venting tube 10, thereby ensuring proper venting and that undesirable pressure differentials don't build up during use.

Figure 12A:
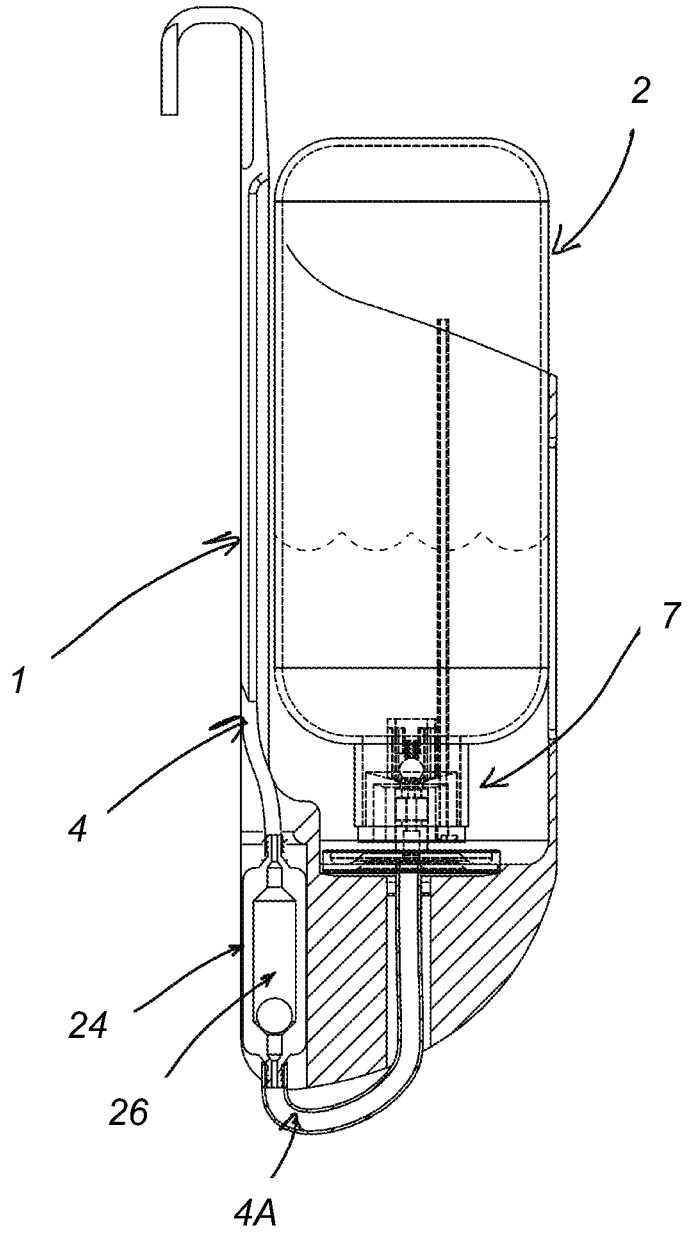
FIG. 12A depicts a side cross-sectional view of another embodiment of a device for automatic dispensing of a liquid that uses volume based dosing according to this invention.
Figure 12B:
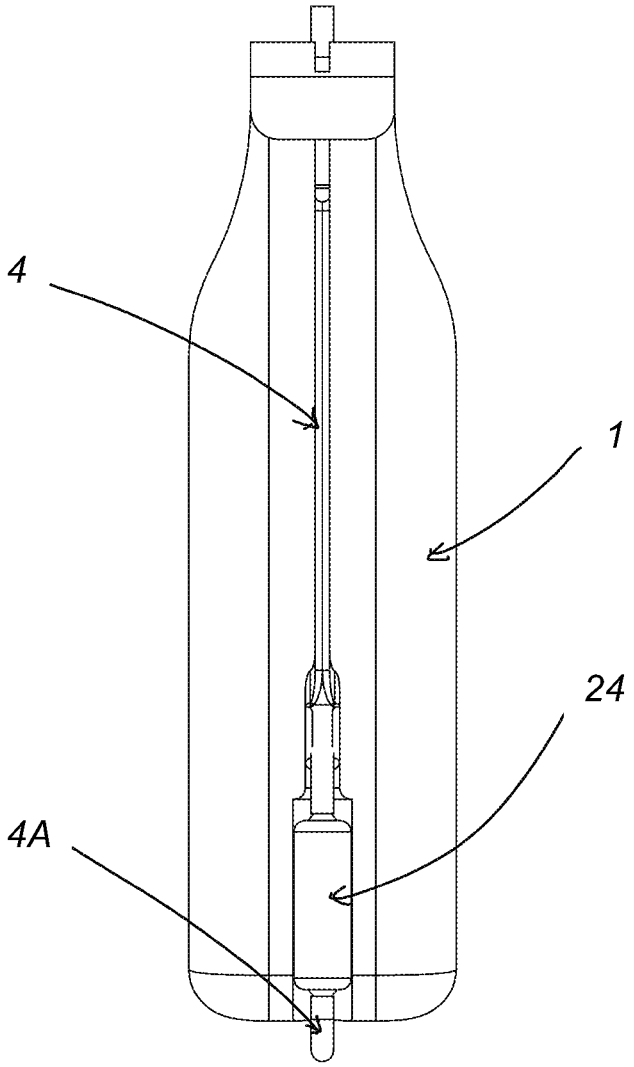
FIG. 12B is a rear view of the device of FIG. 12A.
Figure 13:
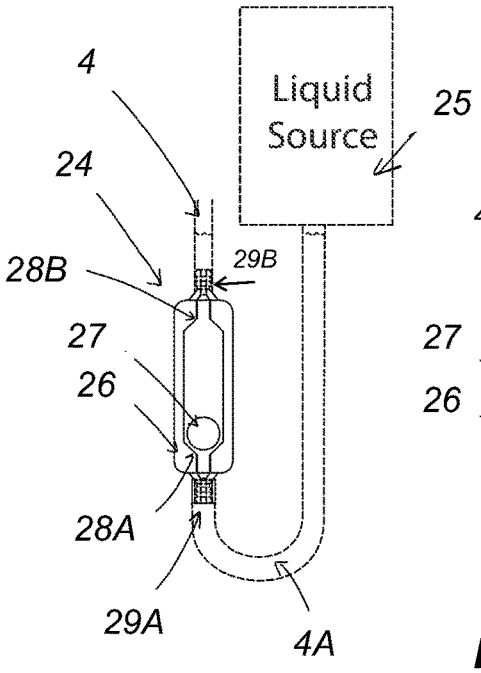
FIG. 13-FIG. 16 illustrate the mechanism by which the volume based dosing system of FIG. 12A restricts the volume of liquid dispensed from the refill tank 2 in use.
Figure 14:
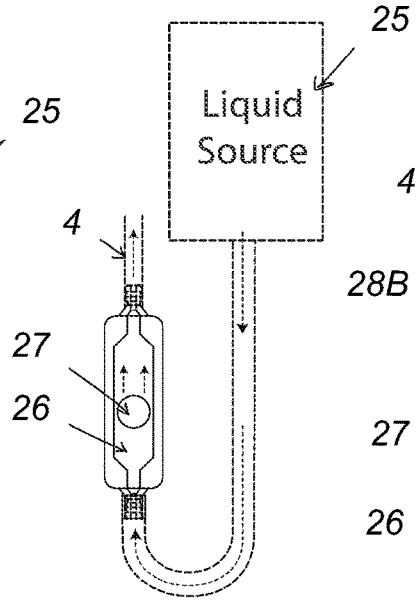
Figure 15:
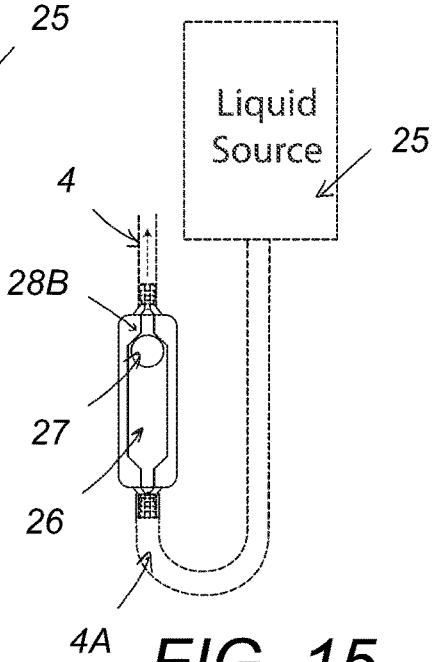
Figure 16:
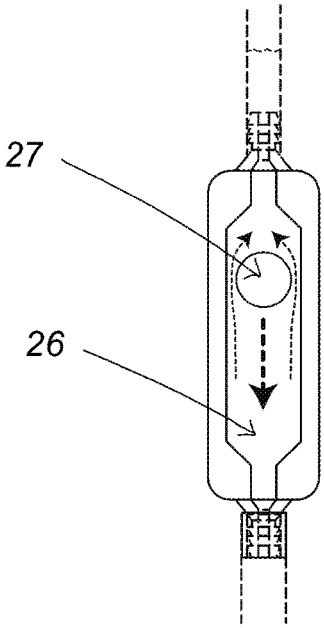

FIG. 12A is a left side cross sectional view of an Automatic Dispensing System consistent with the disclosed embodiment that uses a volume based dosing system 24 to regulate the outflow of Liquid from the refill tank 2. In it a volume based dosing system 24 is positioned beneath the refill tank 2 such that at rest the chamber 26 of the dosing system fills with Liquid. Here, the volume based dosing system 24 is placed on the rear side of the dispenser body 1 such that neither the dosing system and the dispensing line 4 obstruct the planar rear surface of the dispenser body 1, however this mechanism could be successfully placed in a variety of locations in alternative embodiments. FIG. 12B further illustrates the position of these components in the present embodiment.

FIGS. 13-16 illustrate in isolation the means by which the volume based dosing system 24 restricts the volume of liquid dispensed from the refill tank 2 in use. Due to its positioning beneath the liquid level 15 of the refill tank 2, at rest the dosing chamber is full of Liquid. In this state, the valve ball 27 (which in this embodiment is made of a material that is denser than the liquid) is at rest at the bottom of the chamber, held in place by a lower ledge 28. When a suction force develops in the dispensing line 4—due to venturi forces on the far end for instance—that suction draws liquid from the dosing chamber 26 out through the dispensing line 4. This in turn draws additional liquid from the refill tank 2. As Liquid moves through the dosing chamber, its flow causes a valve ball 27 to rise. Eventually, the valve ball 27 reaches the upper shoulder 28B of the dosing chamber, thereby forming a seal against the shoulder and preventing further fluid flow. Since a negligible amount of liquid flows around the valve ball 27 during use, the system releases a volume of liquid roughly equivalent to the volume of the inner dosing chamber 26 minus the volume of the valve ball 27. In this application residual liquid above the volume based dosing system 24 is considered negligible relative to the volume of liquid stored in the dosing chamber 26.

When suction stops, the vacuum holding the valve ball 27 in place no longer acts on the ball, permitting it to release and return to rest at the bottom of the dosing chamber 26. Since the diameter of the valve ball 27 is slightly smaller than that of the dosing chamber, any liquid in the chamber can flow around the ball, allowing the ball to reach a resting point at the bottom of the chamber without any additional venting or actuation. The system is thus reset for subsequent use.

In alternative embodiments, the volume based dosing system 24 may include additional features to facilitate effective and reliable use. The valve ball 27, for instance, may be shaped in a cylindrical or other shape to increase volume, alter buoyancy, or introduce physical features such as flutes, channels, or barbs to break surface tension or allow air to escape the channel when in use. Similarly, the geometry of the upper or lower shoulder 28A, 28B may be optimized to either create a seal or minimally permit fluid or airflow venting during use. The geometry of these components may similarly be optimized to prevent surface tension forces from capturing the ball in a specific position.

The volume based dosing system 24 may also be used in conjunction with other flow regulating mechanism such as a needle valve or tube constriction system, consistent with the description herein. Such a combination of features may be useful in regulating both the volume and the time it takes to dispense a Liquid. Put together, these dosing systems combine with the unique features of the Automatic Dispensing System to advance the state of the art in fluid dispensers—especially for those focused on residential toilets.

Figure 17:
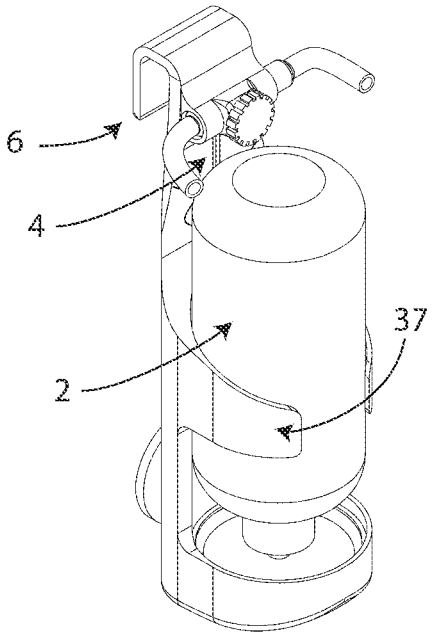
FIG. 17 depicts a front perspective view of yet another embodiment of the device for automatic dispensing of a liquid according to this invention.
Figure 18:
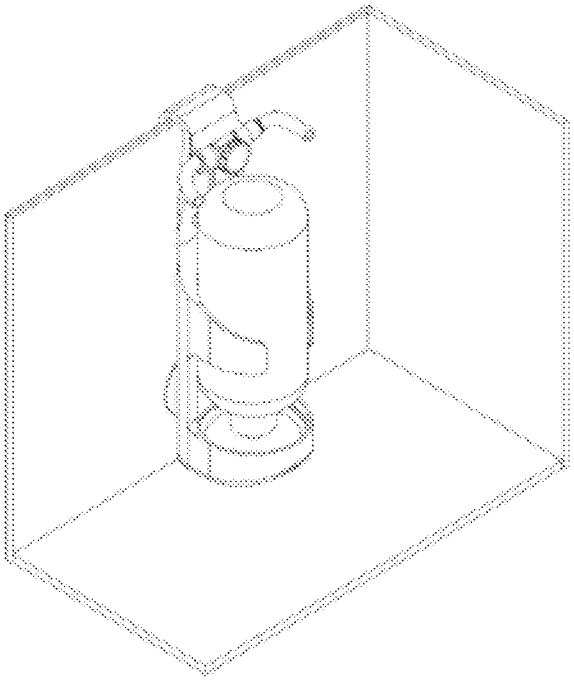
FIG. 18 depicts a front perspective view of the device of FIG. 17 as it is mounted on an inside wall of the toilet tank.

FIG. 17 depicts an embodiment of the device that is completely internal to the toilet tank; that is refill tank 2 is placed within the toilet tank and hidden from the users' view. Such an orientation may be favorable to users in the home setting, when they do not wish to alter the aesthetics of their bathroom or advertise the use of a scent blocking product. Placing refill tank 2 in such an orientation also eliminates the need for crush protection in hook 6, as line 4 is no longer at risk of being crushed by the toilet tank lid. Although this embodiment of the device is shown with rigid hook 6 as a means of attachment, it is understood that the purpose of said hook (keeping the device in place within the toilet tank and stopping any tendency to float at refill tank 2 drains during use) could also be accomplished via individual features or a combination of features such as suction cups, weights, and/or a coupling to attach the device to existing features in the toilet tank and thereby constrain its location. In this embodiment, it may be advantageous to insert the liquid refill bottle from the front or side rather than sliding it into place from above. In such instances, retaining members 37 may be used to hold the bottle 2 in its desired position. FIG. 18 shows the same device in-situ within a toilet tank.

Figure 19:
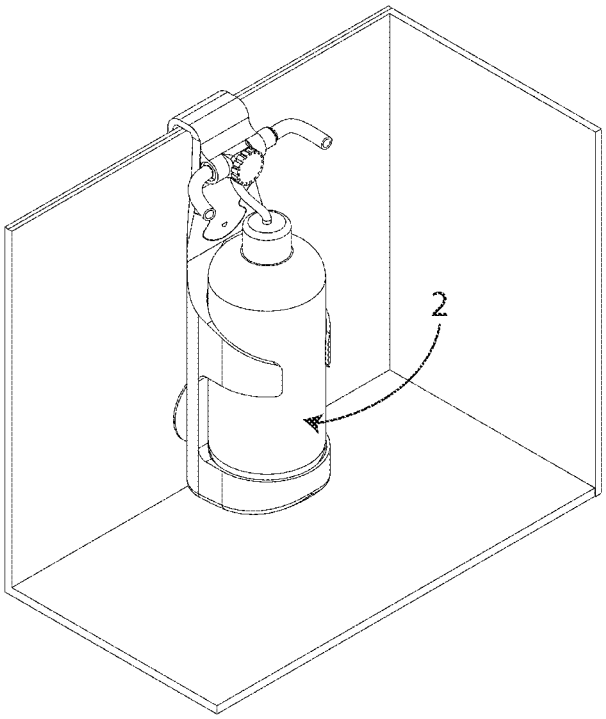
FIG. 19 depicts a front perspective view of yet another embodiment of the device for automatic dispensing of a liquid according to this invention, as it is mounted on an inside wall of the toilet tank.

FIG. 19 depicts an alternative embodiment of the device, where refill tank 2 is placed right-side-up, that is with the fluid exit port on the top face of the bottle as opposed to the bottom face as described earlier. Doing so could potentially reduce the need for fluid release mechanism 7 described earlier, or simplify its action as the bottle would not need to be inverted by the user during installation. For users who wish to keep the device fully contained within the toilet tank, this orientation of refill tank 2 is also helpful as it could enable simple venting of refill tank 2 via the top opening (the bottom of the tank could be submerged in tank water during use, and therefore would not be a good place for a vent hole to let air in as Liquid is drawn out).

Figure 20:
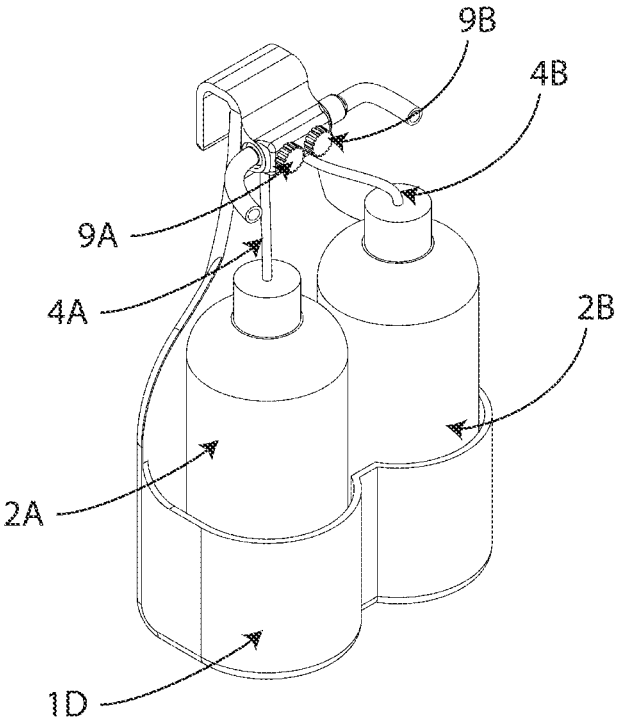
FIG. 20 depicts a front perspective view of another embodiment of the device for automatic dispensing of a liquid according to this invention.
Figure 21:
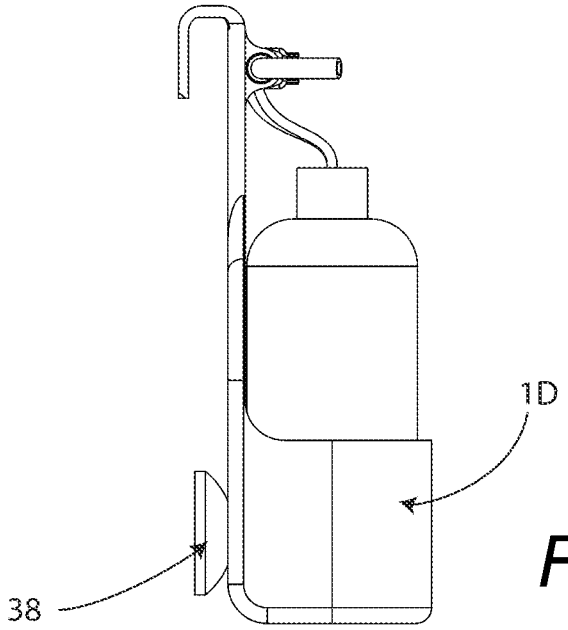
FIG. 21 is a side view of the embodiment of the device of FIG. 20.
Figure 22:
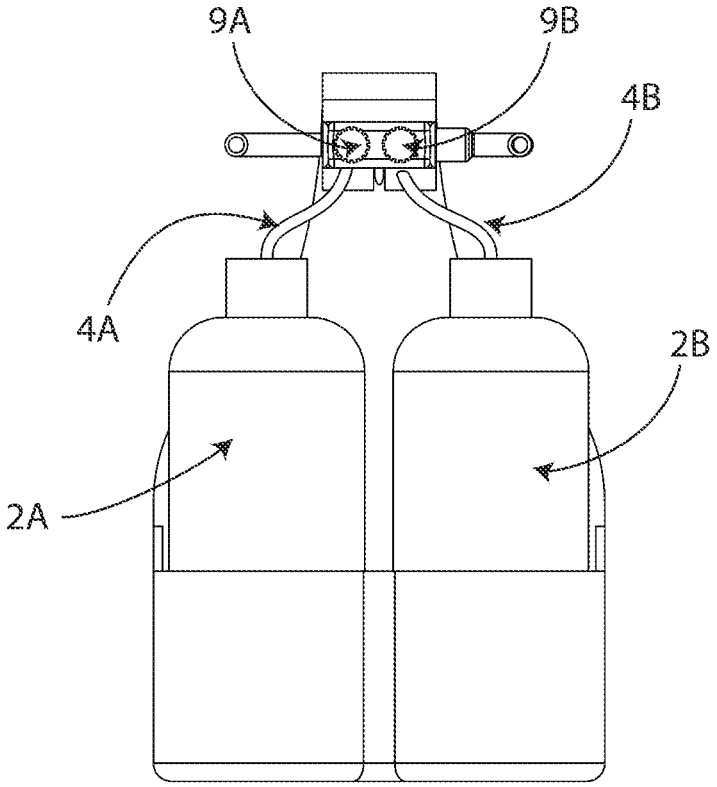
FIG. 22 is a front view of the embodiment of the device of FIG. 20.

FIG. 20 depicts an alternative embodiment of the device, in which two refill tanks 2*a* and 2*b* are loaded at once into a dual tank dispenser 1D. The two tanks could be daisy-chained to a single fluid line that enters the Venturi system 3 or the Venturi system could be adapted slightly to accommodate two incoming Liquid lines, 4*a* and 4*b*, as is shown in FIG. 20. Having two refill tanks could be advantageous, for example, if one refill tank contained a scent blocking fluid, while the other contains a cleaning solution, or a customizable fluid that the user can insert into the secondary tank depending on his or her preferences. This setup can also make possible the combination of solutions that would otherwise not result in a shelf-stable single product, such as a strong oxidizing cleaner (like hydrogen peroxide) and an organic-based scent solution (such as essential oils, which would be quickly oxidized and rendered useless by the hydrogen peroxide). In this dual-bottle embodiment multiple flow regulation methods 9A, 9B may be used to yield a different Liquid flow rate for each bottle. FIG. 21 is a side view of the embodiment in FIG. 20, which illustrates how a tank connection mechanism 38 such as a suction cup may be used to further secure the dispenser body 1D to the tank. Of note, this mechanism may consist of any variety of mechanical features including but not limited to snaps, hooks, cams, weights, anchors, or the like. FIG. 22 further illustrates this embodiment with a front view of the Automatic Dispensing System.

Any of the features depicted and described with these additional figures should be recognized as applicable to this device in isolation or combination, for example there could be a variation with two liquid tanks that sits on the outside of the toilet tank.

Other embodiments include one or more of the following. Device 100 may be attached to the back wall 13*a* via a Velcro hook and loop type attachment 94. In other embodiments, device 100 is attached to the back wall via other mechanical connections, a magnetic connection or via a removable adhesive, among others. The dose of odor shielding liquid is dispensed into the water tank feed line or the toilet bowl directly. The odor shielding liquid may be a bubble forming liquid. The scent tank's shape or location is altered such that it fits better into certain type(s) of toilets. The odor shielding liquid may form an emulsion with bowl water that encapsulates solid waste. The scent tank 2 may be removably attached to the main body 1.

Several embodiments of the present invention have been described. Nevertheless, it will be understood that various modifications may be made without departing from the spirit and scope of the invention. Accordingly, other embodiments are within the scope of the following claims.

What is claimed is:

1. A device for automatic dispensing of a liquid comprising:

a dispenser body;

a container comprising the liquid to be dispensed;

a Venturi tube having an inlet, an outlet and a constriction portion located between the inlet and the outlet, and wherein the inlet is fluidly connected to a fluid source;

a dispensing line connecting the container to the constriction portion of the Venturi tube, wherein the dispenser body comprises a bent portion through which the dispensing line passes;

wherein flowing of fluid from the fluid source through the Venturi tube causes a volume of the liquid to be drawn into the Venturi tube via the dispensing line and wherein the drawn liquid and the fluid are mixed and dispensed via the outlet; and wherein the fluid source comprises a toilet water tank that provides water to a toilet bowl upon flushing activation and wherein the outlet of the Venturi tube is configured to dispense the drawn liquid into a water tank overfill tube that empties into the toilet bowl after flushing.

2. The device of claim 1, further comprising a liquid release assembly removably connected to an opening of the container.

3. The device of claim 2, wherein the liquid release assembly comprises a main body, a through-opening formed in the main body, a spring, and a ball and wherein the ball interfaces with a constriction formed in the through-opening of the main body to form a watertight seal of the through-opening when the spring is extended.

4. The device of claim 3, further comprising a release needle assembly and wherein the release needle assembly comprises a needle that has a first open end that connects to the dispensing line and a second open end that is inserted into the through-opening of the main body and wherein the second open end of the needle is configured to displace the ball in order to release the watertight seal of the through-opening and allow the volume of the liquid to be drawn into the Venturi tube via the dispensing line.

5. The device of claim 4, wherein the release needle assembly further comprises a drip trough configured to collect any unwanted leakage of the liquid.

6. The device of claim 1, wherein the dispenser body is removably attached to a container of the fluid source via one of mechanical connection, magnetic connection, adhesive connection, a hook or a hook and loop type of connection.

7. The device of claim 1, wherein the liquid comprises an odor shielding liquid that mixes with the water that collects in the toilet bowl after flushing and forms an odor shielding film on a top surface of the water that collects in the toilet bowl after flushing.

8. The device of claim 1, wherein the liquid comprises an odor shielding liquid that mixes with the water that collects in the toilet bowl after flushing and the odor shielding liquid forms an emulsion with the toilet bowl water that encapsulates solid waste.

9. The device of claim 1, wherein the liquid comprises one of an odor shielding liquid, a scented liquid, a colorant, enzymes, or a chemical cleaning solution.

10. The device of claim 9, wherein the odor shielding liquid comprises one of odor shielding oils, emulsifiers, thinners, scents, bubble forming liquids, or coloring agents.

11. The device of claim 1, wherein the container is removably attached to the dispenser body.

12. A toilet comprising:

a toilet bowl;

a toilet water tank fluidly connected to the toilet bowl and configured to provide water to the toilet bowl upon flushing activation;

a device for automatic dispensing of a liquid into the toilet bowl after flushing with water is completed;

wherein the device for automatic dispensing of a liquid comprises:

a dispenser body;

a container comprising the liquid to be dispensed;

a Venturi tube having an inlet, an outlet and a constriction portion located between the inlet and the outlet, and wherein the inlet fluidly connects to the toilet water tank;

a dispensing line connecting the container to the constriction portion of the Venturi tube, wherein the dispenser body comprises a bent portion through which the dispensing line passes;

wherein flowing of water from the toilet water tank through the Venturi tube causes a volume of the liquid to be drawn into the Venturi tube via the dispensing line and wherein the drawn liquid and the water are mixed and dispensed via the outlet into a water tank overfill tube that empties into the toilet bowl after flushing with water is completed.

13. A method for automatic dispensing of a liquid comprising:

providing a dispenser body;

providing a container comprising the liquid to be dispensed;

providing a Venturi tube having an inlet, an outlet and a constriction portion located between the inlet and the outlet, and wherein the inlet fluidly connects to a fluid source;

connecting the container to the constriction portion of the Venturi tube via a dispensing line, wherein the dispenser body comprises a bent portion through which the dispensing line passes;

wherein flowing of the fluid from the fluid source through the Venturi tube causes a volume of the liquid to be drawn into the Venturi tube via the dispensing line and wherein the drawn liquid and the fluid are mixed and dispensed via the outlet; and wherein the fluid source comprises a toilet water tank that provides water to a toilet bowl upon flushing activation and wherein the outlet of the Venturi tube is configured to dispense the drawn liquid into a water tank overfill tube that empties into the toilet bowl after flushing.

14. The method of claim 13, further comprising removably connecting a liquid release assembly to an opening of the container, wherein the liquid release assembly comprises a main body, a through-opening formed in the main body, a spring, and a ball and wherein the ball interfaces with a constriction formed in the through-opening of the main body to form a watertight seal of the through-opening when the spring is extended.

15. The method of claim 14, further comprising providing a release needle assembly and wherein the release needle assembly comprises a needle that has a first open end that connects to the dispensing line and a second open end that is inserted into the through-opening of the main body and wherein the second open end of the needle is configured to displace the ball in order to release the watertight seal of the through-opening and allow the volume of the liquid to be drawn into the Venturi tube via the dispensing line.

16. The method of claim 15, wherein the release needle assembly further comprises a drip trough configured to collect any unwanted leakage of the liquid.

17. The method of claim 13, wherein the dispenser body is removably attached to a container of the fluid source via one of mechanical connection, magnetic connection, adhesive connection, a hook or a hook and loop type of connection.

18. The method of claim 13, wherein the liquid comprises an odor shielding liquid that mixes with the water that collects in the toilet bowl after flushing and forms an odor shielding film on a top surface of the water that collects in the toilet bowl after flushing.

19. The method of claim 13, wherein the liquid comprises an odor shielding liquid that mixes with the water that collects in the toilet bowl after flushing and the odor shielding liquid forms an emulsion with the toilet bowl water that encapsulates solid waste.

20. The method of claim 13, wherein the liquid comprises one of an odor shielding liquid, a scented liquid, a colorant, enzymes, or a chemical cleaning solution.

21. The method of claim 20, wherein the odor shielding liquid comprises one of odor shielding oils, emulsifiers, thinners, scents, bubble forming liquids, or coloring agents.

22. A device for automatic dispensing of a liquid comprising:

a dispenser body;

a container comprising the liquid to be dispensed;

a Venturi tube having an inlet, an outlet and a constriction portion located between the inlet and the outlet, and wherein the inlet is fluidly connected to a fluid source;

a dispensing line connecting the container to the constriction portion of the Venturi tube;

a liquid release assembly removably connected to an opening of the container, wherein the liquid release assembly comprises a main body, a through-opening formed in the main body, a spring, and a ball and wherein the ball interfaces with a constriction formed in the through-opening of the main body to form a watertight seal of the through-opening when the spring is extended;

wherein flowing of fluid from the fluid source through the Venturi tube causes a volume of the liquid to be drawn into the Venturi tube via the dispensing line and wherein the drawn liquid and the fluid are mixed and dispensed via the outlet; and wherein the fluid source comprises a toilet water tank that provides water to a toilet bowl upon flushing activation and wherein the outlet of the Venturi tube is configured to dispense the drawn liquid into a water tank overfill tube that empties into the toilet bowl after flushing.

23. The device of claim 22, further comprising a release needle assembly and wherein the release needle assembly comprises a needle that has a first open end that connects to the dispensing line and a second open end that is inserted into the through-opening of the main body and wherein the second open end of the needle is configured to displace the ball in order to release the watertight seal of the through-opening and allow the volume of the liquid to be drawn into the Venturi tube via the dispensing line.

24. The device of claim 23, wherein the release needle assembly further comprises a drip trough configured to collect any unwanted leakage of the liquid.

* * * * *